US008588594B2

(12) United States Patent
Belkin

(10) Patent No.: US 8,588,594 B2
(45) Date of Patent: Nov. 19, 2013

(54) SCALE-INHIBITING ELECTRICAL HEATER AND METHOD OF FABRICATION THEREOF

(76) Inventor: Lev Belkin, Haifa (IL)

( * ) Notice: Subject to any disclaimer, the term of this patent is extended or adjusted under 35 U.S.C. 154(b) by 1178 days.

(21) Appl. No.: 12/493,962

(22) Filed: Jun. 29, 2009

(65) Prior Publication Data

US 2009/0279880 A1 Nov. 12, 2009

Related U.S. Application Data

(63) Continuation of application No. PCT/IL2008/000225, filed on Feb. 21, 2008.

(30) Foreign Application Priority Data

Feb. 22, 2007 (IL) ..... 181500

(51) Int. Cl.
*F24H 1/10* (2006.01)
*H05B 3/40* (2006.01)

(52) U.S. Cl.
USPC ..... 392/465; 392/503

(58) Field of Classification Search
None
See application file for complete search history.

(56) References Cited

U.S. PATENT DOCUMENTS

| | | | | |
|---|---|---|---|---|
| 2,987,689 | A * | 6/1961 | Lennox | 338/238 |
| 3,873,806 | A * | 3/1975 | Schossow | 392/402 |
| 4,319,127 | A * | 3/1982 | Lindstrom et al. | 219/523 |
| 5,013,890 | A * | 5/1991 | Gamble | 392/497 |
| 5,453,599 | A * | 9/1995 | Hall, Jr. | 219/544 |
| 5,586,214 | A * | 12/1996 | Eckman | 392/503 |
| 5,774,627 | A | 6/1998 | Jackson | |
| 5,943,475 | A | 8/1999 | Jackson | |
| 6,205,291 | B1 | 3/2001 | Hughes et al. | |
| 6,571,865 | B1 | 6/2003 | Shi et al. | |
| 6,611,660 | B1 * | 8/2003 | Sagal | 392/497 |
| 6,744,978 | B2 * | 6/2004 | Tweedy et al. | 392/451 |
| 6,909,841 | B2 | 6/2005 | Linow et al. | |
| 7,299,742 | B2 | 11/2007 | Meineke et al. | |
| 2002/0127006 | A1 * | 9/2002 | Tweedy et al. | 392/451 |
| 2006/0028627 | A1 * | 2/2006 | Box | 355/30 |

FOREIGN PATENT DOCUMENTS

| | | | |
|---|---|---|---|
| AU | 13489/70 | | 10/1971 |
| CN | 1587852 | A | 3/2005 |
| EP | 0 869 699 | A2 | 10/1998 |
| GB | 2 244 898 | A | 12/1991 |
| GB | 2 350 538 | A | 11/2000 |
| JP | 2003-197352 | A | 7/2003 |

OTHER PUBLICATIONS

"Information and Specification Reference for PTFE Resin Compounds", Jrlon, Inc., Palmyra, NY, 2012; http://www.jrlon.com/print.php?ptfe-resin-compounds-specs.html.*

International Search Report and Written Opinion, mailed Aug. 7, 2008, from International Application No. PCT/IL2008/000225, filed Feb. 21, 2008.

* cited by examiner

*Primary Examiner* — Thor Campbell
(74) *Attorney, Agent, or Firm* — Browdy and Neimark, PLLC

(57) ABSTRACT

An electrical heater for heating liquid containing at least one scale forming element and methods for fabrication and use of the heater are described. The electrical heater comprises a heating unit including electrical resistance heating material, and a heat conducting sheath disposed over at least a portion of the heating unit. The heater also includes a pair of terminal ends extending from the electrical resistance heating material for connecting the heating unit to an external source of electric power. The heat conducting sheath includes an electrically insulating compound that features anisotropic heat conductivity with enhanced transparency to infra-red radiation along axes normal to a surface of said electrical resistance heating material.

20 Claims, 6 Drawing Sheets

SCALE-INHIBITING ELECTRICAL HEATER AND METHOD OF FABRICATION THEREOF

RELATED APPLICATIONS

This application is a Continuation of International Application No. PCT/IL2008/000225, filed on Feb. 21, 2008, which claims priority to Israeli Patent Application No. 181500, filed on Feb. 22, 2007, both of which are incorporated herein by reference in their entirety.

FIELD OF THE INVENTION

This invention relates to electrical heating devices, and in particular to a scale inhibiting electrical heater and method of fabrication thereof.

BACKGROUND OF THE INVENTION

All natural water contains dissolved chemicals. Some of these chemicals may precipitate on hot surfaces of heaters, forming scale. Mainly, scale contains calcium salts of sulfates, carbonates, oxides, etc. Relatively low concentrations of magnesium, aluminum and iron salts can be also found in scale.

A typical electric heater for heating water and other liquids comprises a heating unit or, more specifically, electrical resistance heating material which converts an electric current flowing through the material into heat. This unit is usually enveloped by a heat conducting sheath comprising one or more layers of electrically insulating compound, which are capable of a reasonably high heat transfer from the heating unit to the liquid. On the other hand, the scale that is formed on the surface of the sheath has poor thermal conductivity. Accordingly, its accumulation may cause the unit to overheat and fail to operate. In addition, mass of the scale may physically deform the heater thus also causing its failure. Finally, scale tends to exfoliate from the heater surface into heated liquid, thus contaminating the liquid.

Various solutions have been proposed to inhibit scale formation on heaters. Some of such techniques are disclosed for example in the following publications: U.S. Pat. No. 7,299,742 to Meineke; U.S. Pat. No. 5,774,627 to Jackson; U.S. Pat. No. 6,744,978 to Tweedy et al.; U.S. Pat. No. 5,586,214 to Eckman; U.S. Pat. No. 6,205,291 to Hughes et al.; U.S. Pat. No. 6,571,865 to Shi et al; and U.S. Pat. No. 6,909,841 to Linow et al.

In particular, U.S. Pat. No. 7,299,742 discloses an apparatus for preparing hot beverages that includes a boiler and a device for inhibiting scale. That device comprises at least one ultrasound transmitter located at the boiler, inside the boiler or in the region of the boiler. The ultrasound transmitter is operatively coupled to the boiler and excites it to oscillate with its natural frequency.

U.S. Pat. No. 6,744,978 describes heating elements and methods for their fabrication and use. The heating elements include a resistance heating material and an electrically insulating, substantially water impervious sheath disposed over the resistance heating material to form an active element portion having an envelope of about 50 $in^3$, a total wattage of at least 1000 W, and a watt density of no greater than 60 $W/in^2$.

U.S. Pat. No. 6,571,865 describes a water heater comprising an exposed heat transfer surface with water in contact with the exposed heat transfer surface. The heat transfer surface includes a layer of tetrahedral amorphous carbon and/or diamond-like carbon, and/or a composite thereof. The heat transfer surface can be used in kettles, washing machines, dishwashers and condensers.

U.S. Pat. No. 6,205,291 discloses a scale-inhibiting water heater element. The water heater element is coated with a diamond-like coating which has low surface tension to keep scale from forming, and is thermally conductive, which helps prevent overheating. The scale-inhibiting water heater element may be fabricated, for example, by coating a standard water heater element with an amorphous silicon adhesion layer, and then applying a diamond-like coating using a pulsed-glow discharge process.

U.S. Pat. No. 5,774,627 discloses an extended life electrical heating element for a water heater that includes a coiled heating resistance wire having a uniform power output per coil turn. Where the heating resistance wire passes through the sheath at critical areas, e.g. return bends, the number of coil turns per unit length of element is reduced to reduce thermal power output per unit length of the element. The number of coil turns per unit length of element in bend areas may be reduced by simply stretching the coiled heating wire to attain the desired length of resistance wire per unit length of the element. Resistance wires of differing heat output per unit length may be combined with different degrees of stretching to achieve the desired element temperatures.

Polymeric heating elements and water heaters containing these elements are provided by U.S. Pat. No. 5,586,214 which utilize polymeric materials contacting with electric resistance heating materials and with liquid to be heated. The heating elements include an electrically conductive resistance material capable of heating liquid when energized. The winding is insulated and protected by a polymer layer integrally disposed over the resistance material.

U.S. Pat. No. 6,909,841 describes an infrared emitter element that includes at least one emitter tube made of silica glass, which has two ends; at least one electrical conductor arranged in the emitter tube as a radiation source; a cooling tube made of silica glass, which surrounds the at least one emitter tube spaced therefrom and which is connected to the at least one emitter tube directly at its ends, such that in the region of the electrical conductor at least one flow-supporting channel is formed between the at least one emitter tube and the cooling tube; and a metallic reflector. The cooling tube is completely covered with the reflector on its side facing away from the emitter tube. The infrared emitter element may be used as a flow-through heater, such as a heat exchanger, especially for high-purity fluids.

U.K. Patent Application GB2244898A describes a heating element for use in heating fluids by immersion of the element therein. The heating element is provided with a coating of a suitable plastics material capable of withstanding the elevated temperatures to which the heating element is subjected and which inhibits the deposition of scale from the heated water on that element.

SUMMARY OF THE INVENTION

Despite the prior art in the area of scale inhibiting techniques, there is still a need in the art for, and it would be useful to have, an electrical heater which can inhibit scale formation when used for heating hard water or other scale forming liquids that contain, inter alia, ions of calcium, magnesium, aluminum, iron, sulfates, carbonates, oxides, or salts formed on the basis of these ions. It would also be advantageous to have a method for inhibiting scale formation on a surface of an electrical heater.

The present invention satisfies the aforementioned need by providing a novel electrical heater for heating liquid containing one or more scale forming elements and methods of fabrication and use thereof.

According to one general aspect of the present invention, there is provided an electrical heater for heating liquid containing at least one scale forming element. Examples of the scale-forming elements include, but are not limited to, ions of calcium, magnesium, aluminum, iron, sulfates, carbonates, oxides, or salts formed on the basis of these ions.

According to one embodiment of the present invention, the electrical heater comprises a heating unit including electrical resistance heating material, a heat conducting sheath disposed over at least a portion of the heating unit, and a pair of terminal ends extending from the electrical resistance heating material for connecting the heating unit to an external source of electric power. The heat conducting sheath has an outer surface, at least a portion of which, in operation, is in contact with the liquid. When desired, a portion of the outer surface that is in contact with the liquid can be polished.

According to one embodiment of the present invention, the heat conducting sheath includes an electrically insulating compound that features anisotropic heat conductivity with enhanced transparency to infra-red radiation along axes normal to a surface of said electrical resistance heating material. When desired, the electrically insulating compound of the heat conducting sheath can feature liquid impermeability and hydrophobic characteristics. Moreover, the compound of the sheath can feature high-temperature stability and have a crystal structure with a crystal lattice different from the crystal lattice of a scale deposit on the outer surface.

According to one embodiment of the present invention, the compound of the heat conducting sheath can be a glass ceramic compound. An example of the glass ceramic compound includes, but is not limited to, ZERODUR.

According to one embodiment of the present invention, the compound of the heat conducting sheath can be doped with one or more scale-forming elements.

According to one embodiment of the present invention, the heating unit of the present invention can be straight shaped, U-type shaped, zigzag shaped, spiral shaped, coil shaped, and serpentine shaped.

According to one embodiment of the present invention, electrical resistance heating material of the heating unit features high-temperature stability and low thermal expansion.

According to one embodiment of the present invention, the heating material can be in a form of a shaped wire or a flat wire. A cross-sectional shape of the shaped wire can, for example, be round shape, oval shape, polygonal shape, and/or D-shape.

According to one embodiment of the present invention, the heating material can be doped with one or more scale-forming elements.

The electrical heater of the present invention has many of the advantages of the techniques mentioned theretofore, while simultaneously overcoming some of the disadvantages normally associated therewith.

The electrical heater of the present invention is energetically economic and operates with minimal losses of heat radiation.

The electrical heater according to the present invention may be easily and efficiently fabricated and marketed.

The electrical heater according to the present invention is of durable and reliable construction.

The electrical heater according to the present invention may have a low manufacturing cost.

According to another general aspect of the present invention, there is provided a method of fabrication of an electrical heater for heating liquid containing at least one scale forming element. The method comprises providing a heating unit including electrical resistance heating material, and disposing of a heat conducting sheath over at least a portion of the heating unit. The method also comprises providing a pair of terminal ends and applying them to the heating material for connecting the heating unit to an external source of electric power. When desired, the fabrication method can also include polishing at least a portion of an outer surface of the sheath.

According to one embodiment of the present invention, the disposing of the sheath includes steps of placing at least a portion of the heating unit together with the compound of the sheath in a die and applying at least one of pressure or heat thereto.

According to one embodiment of the present invention, the providing of the heating unit includes the steps of providing the heating material, placing it in a die, and applying at least one of pressure or heat to the heating material.

According to one embodiment of the present invention, the method can comprise doping the electrically insulating compound of the heat conducting sheath with one or more scale-forming elements.

According to one embodiment of the present invention, the method can comprise doping the electrical resistance heating material of the heating unit with one or more scale-forming elements.

According to still another general aspect of the present invention, there is provided a method of inhibiting scale formation on a surface of an electrical heater for heating liquid containing at least one scale forming element. The method comprises disposing a heat conducting sheath over at least a portion of the heating unit of the heater.

According to one embodiment of the present invention, the heat conducting sheath of the method includes an electrically insulating compound that features anisotropic heat conductivity with enhanced transparency to infra-red radiation along an axes normal to a surface of said electrical resistance heating material. When desired, the electrically insulating compound of the heat conducting sheath can feature liquid impermeability and hydrophobic characteristics. Moreover, the compound of the sheath can feature high-temperature stability and have a crystal structure with a crystal lattice different from the crystal lattice of a scale deposit on the outer surface.

According to one embodiment of the present invention, the method can also include polishing at least a portion of an outer surface of the sheath which, in operation, is in contact with the liquid.

According to one embodiment of the present invention, the method can comprise doping the electrically insulating compound of the heat conducting sheath with one or more scale-forming elements.

According to one embodiment of the present invention, the method can comprise doping the electrical resistance heating material of the heating unit with one or more scale-forming elements.

There has thus been outlined, rather broadly, the more important features of the invention so that the detailed description thereof that follows hereinafter may be better understood, and the present contribution to the art may be better appreciated. Additional details and advantages of the invention will be set forth in the detailed description.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF THE PREFERRED EMBODIMENTS

Figure 1:
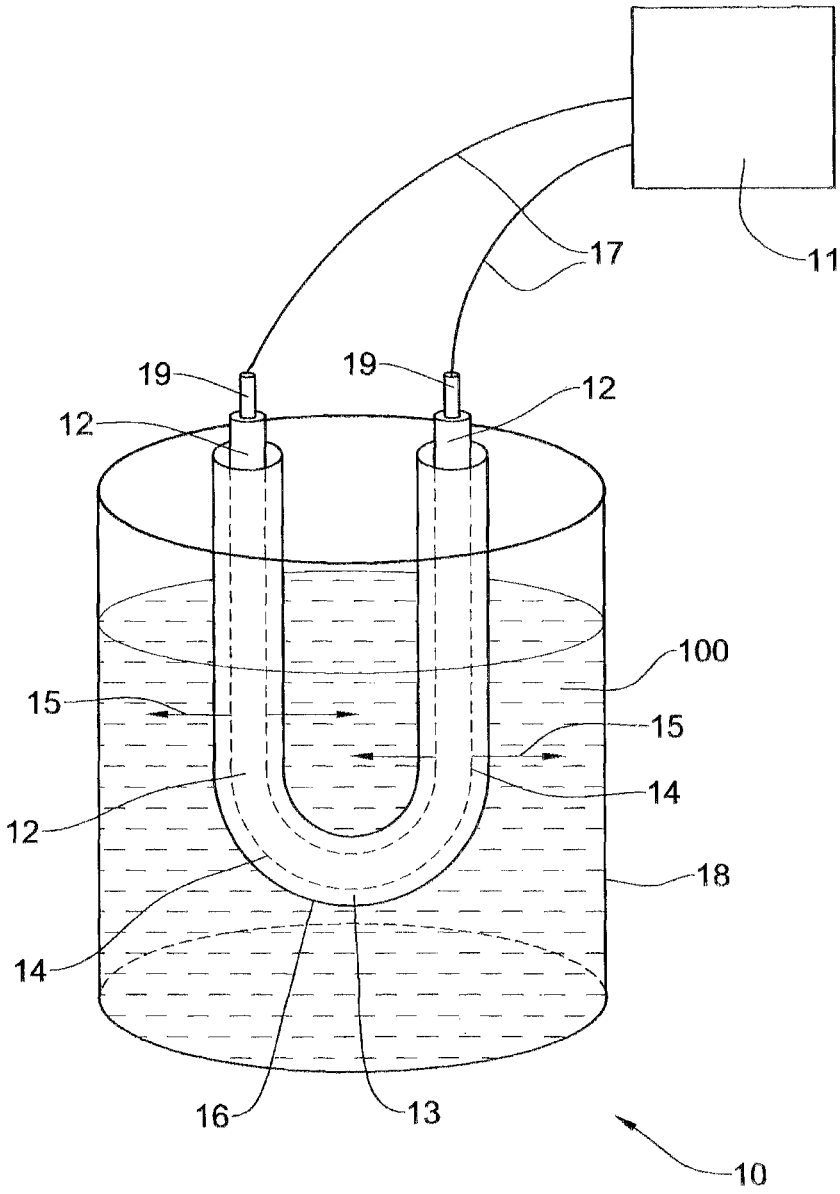
FIG. 1 is a schematic representation of an electrical heater for heating liquid containing at least one scale forming element, according to one embodiment of the present invention.

The principles of the method according to the present invention may be better understood with reference to the drawings and the accompanying description, wherein like reference numerals have been used throughout to designate identical elements. It should be understood that these drawings, which are not necessarily to scale, are given for illustrative purposes only, and are not intended to limit the scope of the invention. Examples of constructions and manufacturing processes are provided for selected elements. Those versed in the art should appreciate that many of the examples provided have suitable alternatives which may be utilized.

Referring to FIG. 1, there is provided a schematic representation of an electrical heater 10 for heating liquid 100 containing one or more scale forming elements, according to an embodiment of the present invention. The electrical heater 10 includes a heating unit 12 including electrical resistance heating material. The electrical heater 10 also includes a pair of terminal ends 19 associated with the heating unit 12 and extend from its electrical resistance heating material. The terminal ends 19 are electrically connected to an electric power source 11 through electric leads 17. The heater 10 is placed into a tank 18 containing liquid 100.

At least a portion of the heating unit 12 is enveloped by a heat conducting sheath 13 that includes an electrically insulating compound. According to the embodiment shown in FIG. 1, the sheath 13 is in the form of a round tube that surrounds a part of the heating unit 12. It should be understood that the sheath 13 can be of any desired shape or dimension. In operation, at least a portion of the sheath is in contact with the liquid 100.

According to one embodiment of the present invention, the compound of the sheath 13 features anisotropic heat conductivity with enhanced transparency to infra-red radiation along axes 15 normal to a surface 14 of the electrical resistance heating material. When desired, the compound can also feature liquid impermeability and hydrophobic characteristics. Moreover, the electrically insulating compound may have high-temperature stability and a crystal structure with a crystal lattice different from the crystal lattice of a scale deposit that in operation may be formed on an outer surface 16 of the sheath 13.

According to one embodiment of the present invention, a portion of the outer surface 16, which is in contact with the liquid, can be polished.

According to one embodiment of the present invention, the electrically insulating compound of the sheath 13 can be a glass ceramic compound. The glass ceramic compound may include an inorganic, substantially non-porous material. Such a material usually has a crystalline phase and a glassy phase, and may feature, inter alia, a very low coefficient of thermal expansion (CTE) in addition to the features described above.

An example of the glass ceramic compound includes, but is not limited to, ZERODUR® that may, for example, be available from Schott Glass Technologies. ZERODUR has numerous crystalline phases, such as cordierite, spodumene, eucryptite, etc. For example, the cordierite crystalline phase of ZERODUR has a hexagonal crystal lattice. ZERODUR also has anisotropic heat conductivity with enhanced transparency to infra-red radiation. Accordingly, when ZERODUR is used for the sheath 13, heat radiation along the axes 15 that is normal to the surface 14 of the resistance heating material is substantially higher than the radiation in the direction tangential to the surface 14. Moreover, ZERODUR combines high hardness and mechanical strength with high softening temperature and chemical resistance.

Depending on the requirements for electric insulation, when desired, the surface of the heating unit 12 can be covered by one or more additional layers of insulating material, separating the heating unit 12 from the sheath 13. Such additional layers can be made of a polymer, thermoplastic or thermosetting resin, or any other compound.

Figure 2A:
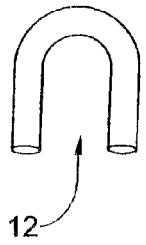
FIGS. 2A through 2E are non-limiting examples of schematic configurations of the heating unit used in the electrical heater shown in FIG. 1, according to one embodiment of the present invention.
Figure 2B:
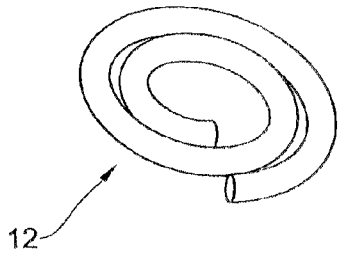
Figure 2C:
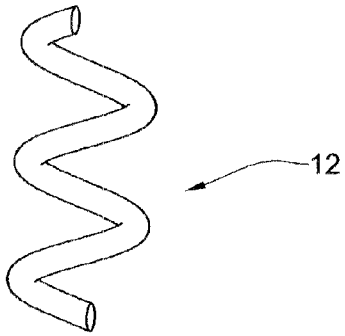
Figure 2D:
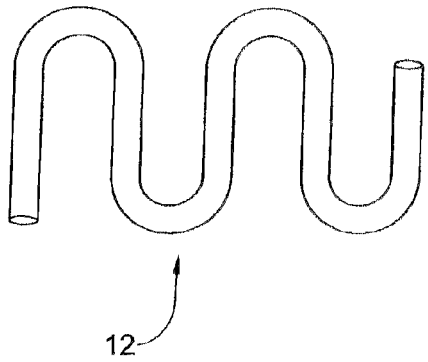
Figure 2E:
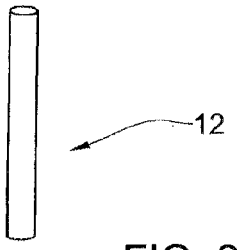

Referring to FIGS. 2A through 2E together, non-limiting examples of schematic configurations of the heating unit of the present invention are illustrated. Specifically, FIG. 2A shows an exemplary heating unit 12 having a pattern of a U-type shape. FIG. 2B shows an exemplary heating unit 12 having a spiral shape. FIG. 2C shows an exemplary heating unit 12 having a coil shape. FIG. 2D shows an exemplary heating unit 12 having a serpentine shape. FIG. 2E shows an exemplary heating unit 12 having a straight shape.

According to one embodiment of the invention, the electrical resistance heating material of the heating unit 12 features high-temperature stability and low thermal expansion. The electrical resistance heating material can, for example, be provided as a wire. The term 'wire' is construed here in a broad meaning and can be in a solid state or fluid state; and realized in a bulk form, powder form, or paste form. The wire can be implemented as a shaped wire or a flat wire. A cross-sectional shape of the shaped wire can, for example, be a round shape, oval shape, polygonal shape, and/or D-shape. The electrical resistance heating material may, for example, be a metal, metal alloy, conductive polymer, ceramics, or composition thereof.

The choices of the materials and configuration of the heating unit determine the working temperature of the heating unit. As will be described hereinbelow, depending on the working temperature of the surface of the heating unit, scale having two different crystalline structures of calcium carbonate can be formed, such as aragonite that is mainly suspended in the liquid bulk, or calcite that mainly precipitates on the surface of the heater. According to one embodiment of the present invention, the working temperature of the outer surface (16 in FIG. 1) of the sheath (13 in FIG. 1) should not exceed about 470° C. in order to decrease the formation of calcite.

Figure 3:
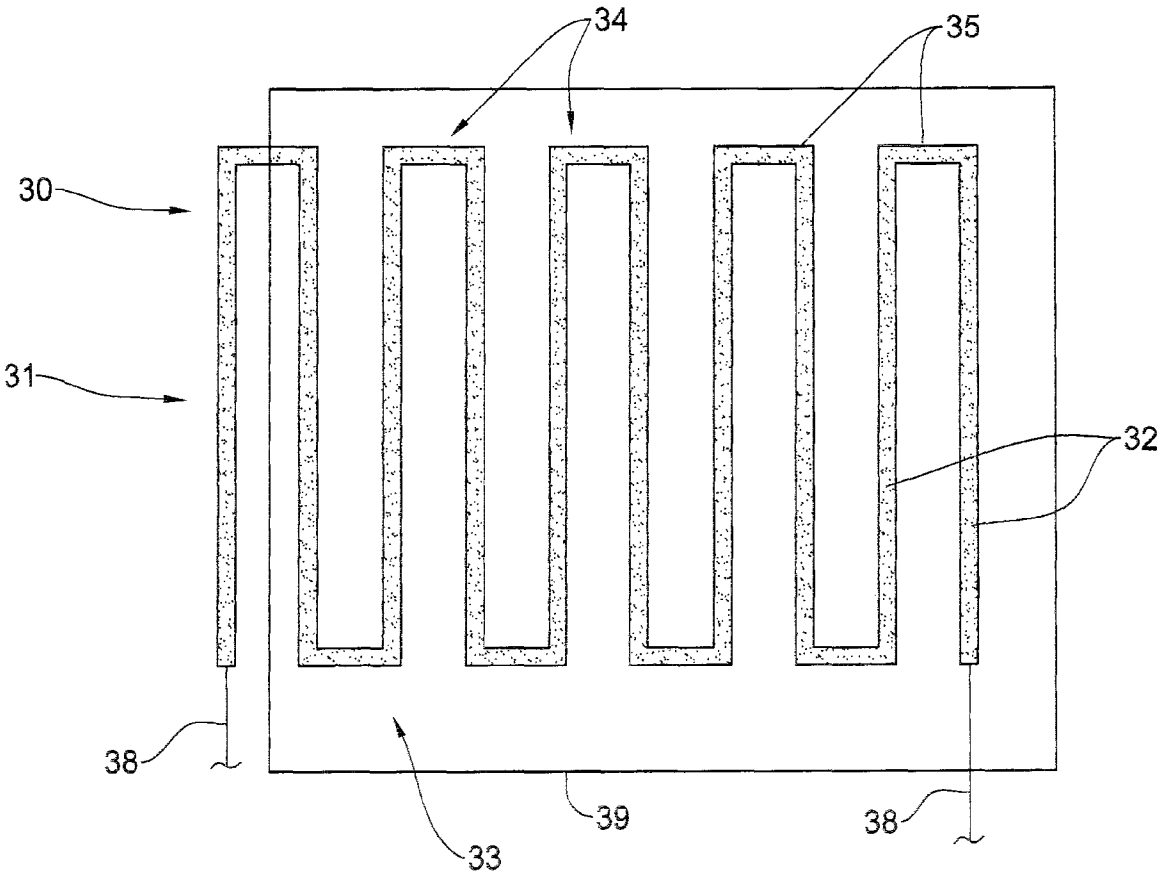
FIG. 3 is a schematic view of a configuration of the electrical heater having a serpentine heating unit, according to another embodiment of the present invention.

Referring to FIG. 3, a schematic view of a configuration of an electrical heater 30 having a serpentine heating unit is illustrated, according to another embodiment of the present invention. The heater 30 includes a heating unit 31 in the form of a flat wire 33 having a serpentine shape. At least a portion of the heating unit 31 is enveloped by a heat conducting sheath 39. According to this embodiment, the sheath 39 is a block of electrically insulating compound in which the heating unit 31 is embedded. The flat wire 33 includes a plurality of bends 34 and a plurality of elongated runs 32. The heating unit 31 includes a pair of terminal ends 38 for electrical coupling the heating unit 31 to an electric power source (not shown).

According to a further embodiment, the surface of the flat wire forming the heating unit 31 is rough, thereby increasing a heat emitting ability of the heating unit 31. In practice, the surface should preferably has maximal roughness.

According to this embodiment, the heating unit utilizes a flat wire. It is believed by the Applicant that a rate of heat emission of the heater using a flat heating wire is greater than that of a corresponding round wire. Indeed, a rate of heat emission can be expressed by the following relationship: $dQ/d=F\cdot a\cdot(T_1-T_2)$, where Q is the heat emission of the heating unit, F is the surface emission area of the heating unit, a is a coefficient of heat emissive that depends on the material, $T_1$ is a temperature of the heating surface, and $T_2$ is a temperature of the heated liquid.

It should be understood that the rate of heat emission dQ/dt depends on the surface area F. Accordingly, the surface emission area F of the heater that employs flat wire can be greater than the surface emission area of a heater having the same dimension and heating material, but employing the round wire.

According to one embodiment of the present invention, the bends 34 are made of a rectangular shape rather than of a curved shape. It is believed that a heat flow from curved bends is greater than the heat flow from straight sections. This may result in overheating the heating unit at the bend regions and failure of the heater (see, for example, U.S. Pat. Nos. 5,774,627 and 5,943,475). Accordingly, in order to achieve a relatively uniform heat flow emitted by the heating unit 31 along its length, the rectangular bends 34 composed of straight short runs 35 are used rather than the curved bends (as shown in FIG. 2D).

Figure 4A:
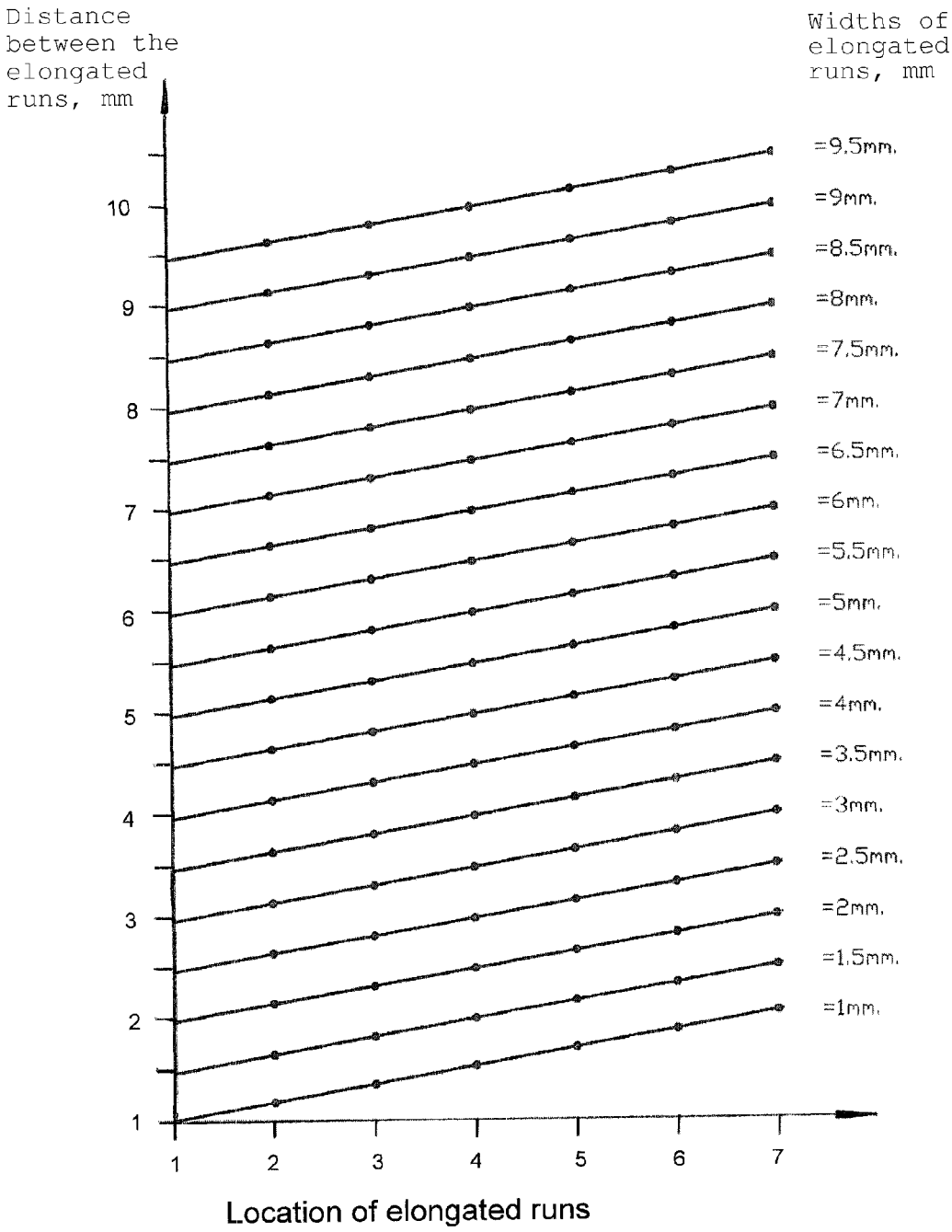
FIG. 4A is a plot illustrating an exemplary relationship between the width of elongated runs of the heating unit shown in FIG. 3, the distance between the elongated runs and the location of the elongated runs with respect to the center of the heating unit.
Figure 4B:
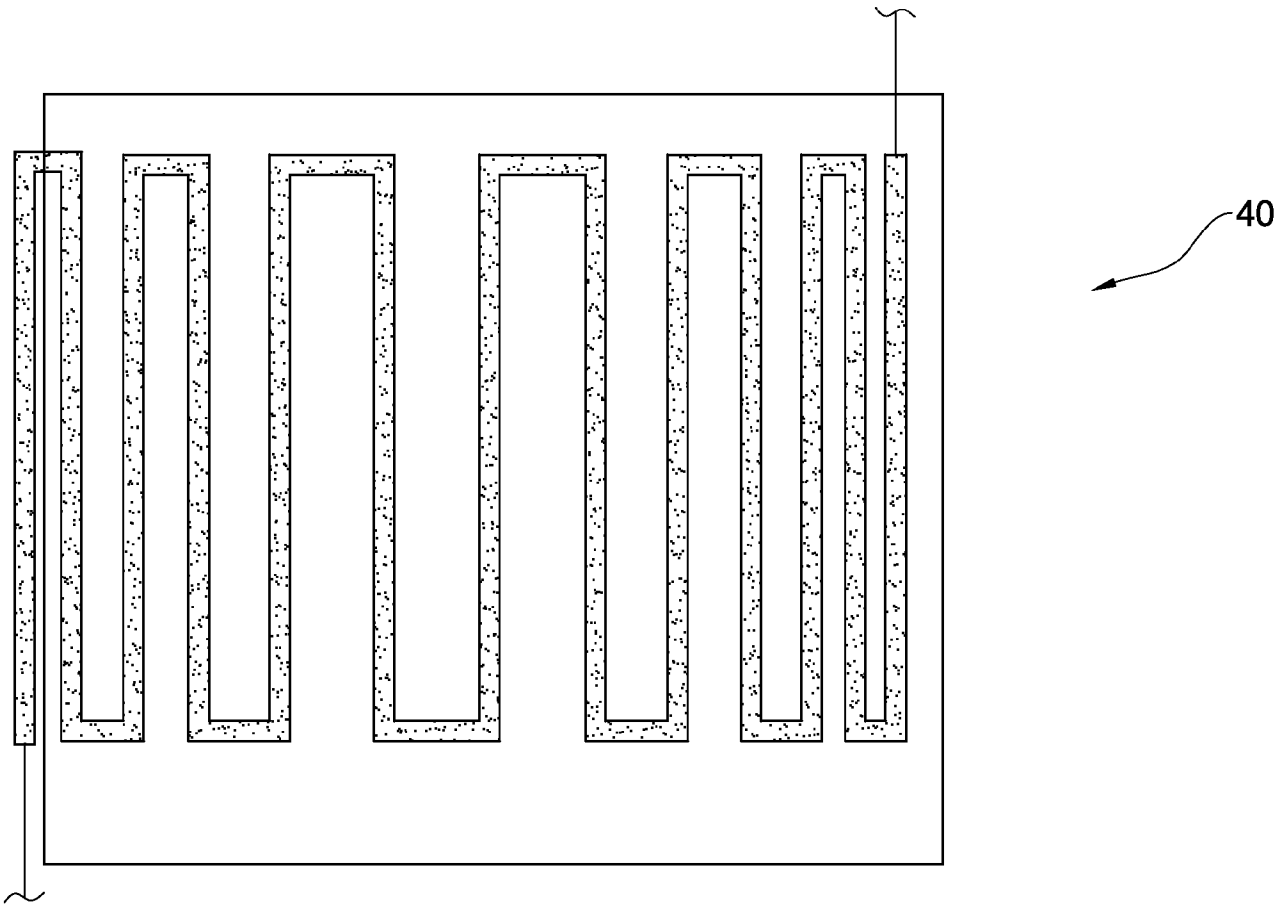
FIG. 4B is a schematic view of an electrical heater fabricated in accordance with the plot shown in FIG. 4A.

According to a further embodiment of the present invention, the distance between the elongated runs varied as a function of the width of the elongated run and location of the elongated runs with respect to the center of the heating unit. FIG. 4A is a plot illustrating an exemplary relationship between the width of elongated runs of the heating unit shown in FIG. 3, the distance between the elongated runs and the location of the elongated runs with respect to the center of the heating unit. For example, when the width of the elongated run is 6.5 mm, and this elongated run is a fourth element from a closest edge of the heating unit, then the distance between this elongated run and the fifth run is about 7 mm. FIG. 4B illustrates a schematic view of an electrical heater 40 fabricated in accordance with these principles. As can be seen in FIG. 4B, a distance between the elongated runs at the center is greater than the distance near the edges of the heating unit.

It should be understood that such a configuration of the heating unit provides a uniform distribution of the emitted heat and reduced temperature of the heating material, when compared to the heating unit having a uniform distribution of the elongated runs from the center.

The electrical heater of the present invention has many of the advantages of the techniques mentioned theretofore, while simultaneously overcoming some of the disadvantages normally associated therewith. The electrical heater of the present invention may be suitable for any private or industrial application. Being water- and chemically-resistant, the heater of the present invention can be applied for heating any liquid containing scale-forming elements. It is energetically economic and operates with minimal losses of heat radiation.

Figure 5:
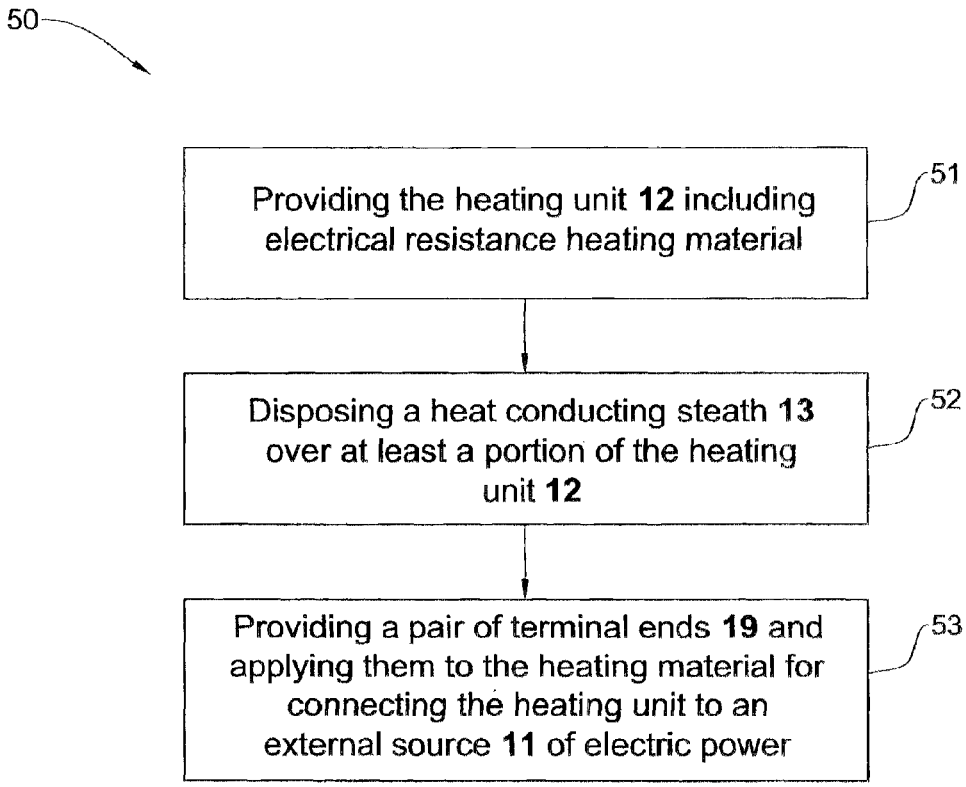
FIG. 5 is a block diagram of a fabrication method of the electrical heater, according to one embodiment of the present invention.

FIG. 5 illustrates a flow chart of an exemplary method 50 of fabrication of an electrical heater of the present invention. For convenience of understanding, the reference numerals used in FIG. 1 for identification of the components of the electrical heater are also used for description of the method 50. The method 50 includes providing the heating unit 12 (step 51) including electrical resistance heating material; disposing a heat conducting sheath 13 over at least a portion of the heating unit 12 (step 52), providing a pair of terminal ends 19 and applying them to the heating material for connecting the heating unit to an external source of electric power 11 via leads 17 (step 53). When desired, the fabrication method can also comprise polishing at least a portion of an outer surface of the sheath 13 that is in contact with the liquid.

As described above, the heat conducting sheath includes an electrically insulating compound that features anisotropic heat conductivity with enhanced transparency to infra-red radiation along axes normal to a surface of said electrical resistance heating material. When desired, the electrically insulating compound of the heat conducting sheath can feature liquid impermeability and hydrophobic characteristics. Moreover, the compound of the sheath can feature high-temperature stability and have a crystal structure with a crystal lattice different from the crystal lattice of a scale deposit on the outer surface. The compound of the heat conducting sheath can be a glass ceramic compound, such as ZERODUR.

According to one embodiment of the present invention, the step 51 of providing of the heating unit 12 includes providing the electrical resistance heating material. The heating material can be either in a solid or liquid state. The method further includes placing the material in a die, and applying either heat or heat and pressure together to the heating material. The heat temperature and/or pressure depend on the chemical composition of the heating material. For example, when the heating material is nickel-based alloy and only heat is applied to the electrical resistance heating material placed in the die, the temperature can be in the range of 1500° C.-1700° C. In turn, when both heat and pressure are applied to the material, the temperature can be in the range of 1500° C.-1700° C. while the pressure can be 10 $kg/m^2$ and greater.

According to one embodiment of the present invention, the step 52 of disposing of the sheath over the heating unit 12 includes placing at least a portion of the heating unit 12 prepared in advance together with the electrically insulating compound of the sheath 13 in a die and applying heat thereto in order to embed the heating unit 12 into the compound of the sheath 13. For example, the temperature can be in the range of 1100° C.-1300° C.

When a temperature of fabrication of the heating unit is greater than the temperature used in fabrication of the sheath, the casting of the compound in presence of the heating unit 12 can be carried out without damage of the heating unit structure.

According to one embodiment of the present invention, the electrical resistance heating material and/or electrically insulating compound can be doped with one or more scale-forming elements. The doping of the heating material can be provided during the step of fabrication of the heating unit 12. Specifically, one or more scale-forming elements are mixed with the heating material before its placing in the die. Likewise, the doping of the compound can be made before or during the step 52 of disposing of the heat conducting sheath 13 over the heating unit 12.

According to another general aspect of the present invention, there is provided a method for inhibiting scale formation on a surface of an electrical heater for heating liquid containing at least one scale forming element. The electrical heater has a heating unit including electrical resistance heating material. The method includes disposing a heat conducting sheath over at least a portion of the heating unit of the heater.

As described above, the heat conducting sheath includes an electrically insulating compound that features anisotropic heat conductivity with enhanced transparency to infra-red radiation along axes normal to a surface of said electrical resistance heating material. When desired, the electrically insulating compound of the heat conducting sheath can feature liquid impermeability and hydrophobic characteristics. Moreover, the compound of the sheath can feature high-temperature stability and have a crystal structure with a crystal lattice different from the crystal lattice of a scale deposit on the outer surface. The compound of the heat conducting sheath can be a glass ceramic compound, such as ZERODUR.

When desired, the method for inhibiting scale formation further comprises polishing at least a portion of an outer surface of the sheath.

The scale inhibiting properties of the sheath can be better understood from the following explanation.

A scale formation in liquids is a result of a super-saturation of one or more scale-forming elements dissolved in the liquid and following crystallization of the elements. The super-saturation is achieved when concentration of the element(s) exceed their equilibrium state in the liquid. The crystallization of the element is developed in two stages, such as a crystal nucleation, and a further crystal growth, for example, to the visible size. Generally, the crystallization rate is limited by the nucleation rate, which depends on temperature.

Accordingly, when a temperature on a heater surface is higher than the temperature of a heated liquid, the super-saturation rate of the scale-forming elements, the crystal nucleation rate, and the corresponding scale formation rate on the surface are all greater than in the liquid bulk.

On the other hand, when a temperature of the surface of the heater is lower than the temperature in the bulk of the heated liquid, the generation of crystal nuclei is greater in the liquid bulk than on the heater's surface. In other words, the crystals formed from the scale-forming elements are formed in the bulk of the heated liquid.

The processes of scale formation can be better understood by the example of scale formation for calcium carbonate.

A concentration of calcium carbonate in liquid depends on the concentrations of ions of calcium ($Ca^{2+}$) and bicarbonate ($HCO_3^-$). As understood from the following equilibrium reaction, the bicarbonate is an intermediate product of an interrelated breakdown of carbonic acid ($H_2CO_3$) and an interaction of carbon dioxide ($CO_2$) with water:

$$CO_2+H_2O \leftrightarrow H_2CO_3 \leftrightarrow HCO_3^-+H^+$$

The rate and direction of the reaction depend, inter alia, on the water temperature. In particular, when the temperature decreases, the interaction of carbon dioxide with water increases, thereby directing the reaction towards the increase of concentration of carbonic acid.

Bicarbonate salt of calcium ($Ca(HCO_3)_2$) can be formed when a positively charged calcium ion ($Ca^{2+}$) reacts with two ions of bicarbonate ($HCO_3^-$). Calcium bicarbonate is an unstable compound, and therefore can break down into calcium carbonate salt ($CaCO_3$), carbon dioxide ($CO_2$) and water. Moreover, calcium carbonate can also react with water that is saturated with carbon dioxide, thereby to form soluble calcium bicarbonate.

$$Ca^{2+}+2HCO_3^- \leftrightarrow Ca(HCO_3)_2 \leftrightarrow CaCO_3+CO_2+H_2O$$

On the other hand, when temperature of the water increases, concentration of $CO_2$ dissolved in water decreases. As a result, the reaction will lead to the formation of calcium carbonate. This salt mainly exists in two crystalline structures, such as calcite, which is mainly precipitated on the surfaces, and aragonite which is mainly suspended in liquid. Calcite is the most stable polymorph of calcium carbonate. A calcite crystal has a trigonal-rhombohedral crystal lattice. In contrast, an aragonite has an orthorhombic crystal lattice. The conditions are formed in the liquid for formation of calcite when the temperature of aragonite-containing liquid exceeds 470° C.

When the concentration of calcium carbonate in liquid is permanent, super-saturation of this salt is mainly determined by temperature gradient between the heating surface and the liquid bulk.

According to the present invention, the sheath's compound features anisotropic heat conductivity with enhanced transparency to infra-red (IR) radiation along axes normal to a surface of the resistance heating material. Taking into account these properties of the sheath's compound, it is possible to direct the heating radiation into a certain region in the liquid bulk, thereby forming a so-called "working heating volume", that is located near the surface of the sheath. Thus, heat will be concentrated at the "working heating volume", and, as a result, a temperature gradient is formed between the "working heating volume" and the other liquid volume, rather than between the "working heating volume" and the surface of the heater.

Moreover, the process of forming the "working heating volume" leads to super-saturation of the dissolved scale-forming element, that follows crystal nucleation occurring inside the "working heating volume". In other words the crystal nucleation occurs mainly in the liquid bulk, rather than on the surface of the sheath.

According to another embodiment of the invention, either the sheath or the heating unit can be doped with one or more scale-forming elements (such as ions of calcium, magnesium, aluminum, iron, sulfates, carbonates, oxides, or salts formed on the basis of these ions) contained in the liquid. When the heating unit emits heat through the sheath, the heating unit and the sheath will both emit IR heat radiation at a frequency coinciding with the self-resonance oscillation frequencies of atoms and molecules of the scale-forming elements presented in the liquid, thereby activating them. Such activation "converts" these elements into scale nucleation centers in the liquid bulk, thereby decreasing scale formation on the sheath's surface.

According to one embodiment of the present invention, the compound of the sheath can inhibit initiation of scale nucleation on the surface, if crystal lattices of the sheath's compound and crystal lattices of scale composite are different. It is believed that the initiation of the nucleation can take place only if a difference between a crystal syngony of the surface compound and that of the scale formed on the surface does not exceed 20%. Thus, in the case of a calcite scale and a sheath made of ZERODUR, hexagonal crystal syngony with translation period of 9.841 Å of ZERODUR differs from that of calcite that has trigonal-rhombohedral syngony and translation period of 6.37 Å by 54.8%. In other words, surface of the sheath made of ZERODUR inhibits initiation of calcite scale nucleation, due to the difference between their crystal lattices.

In addition, smooth polishing of the outer surface of the sheath can also reduce the possibility of the scale formation on the surface. The polishing reduces surface cavities, which can serve as a surface matrix for scale-forming crystallization. Thus, the polishing of the surface of the sheath contacting with the liquid will decrease the rate of scale formation.

As such, those skilled in the art to which the present invention pertains, can appreciate that while the present invention has been described in terms of preferred embodiments, the conception, upon which this disclosure is based, may readily be utilized as a basis for the designing of other structures systems and processes for carrying out the several purposes of the present invention.

In the method claims that follow, alphabetic characters used to designate claim steps are provided for convenience only and do not imply any particular order of performing the steps.

Also, it is to be understood that the phraseology and terminology employed herein are for the purpose of description and should not be regarded as limiting.

Finally, it should be noted that the word "comprising" as used throughout the appended claims is to be interpreted to mean "including but not limited to".

It is important, therefore, that the scope of the invention is not construed as being limited by the illustrative embodiments set forth herein. Other variations are possible within the scope of the present invention as defined in the appended claims.

What is claimed is:

1. An electrical heater for heating liquid containing at least one scale forming element, comprising:

a heating unit including electrical resistance heating material, a heat conducting sheath including electrically insulating compound and disposed over at least a portion of said heating unit; where said heat conducting sheath has an outer surface at least a portion of which being in contact with the liquid, said electrically insulating compound of the sheath features anisotropic heat conductivity with enhanced transparency to infra-red radiation along axes normal to a surface of said electrical resistance heating material; and a pair of terminal ends extending from said electrical resistance heating material for connecting said heating unit to an external source of electric power.

2. The electrical heater of claim 1, wherein at least a portion of the outer surface that is in contact with the liquid is polished.

3. The electrical heater of claim 1, wherein said electrically insulating compound of the sheath features liquid impermeability and hydrophobic characteristics.

4. The electrical heater of claim 1, wherein said electrically insulating compound features high-temperature stability, and said electrically insulating compound has a crystal structure with a crystal lattice different from the crystal lattice of a scale deposit on the outer surface.

5. The electrical heater of claim 1, wherein said electrically insulating compound is a glass ceramic compound.

6. The electrical heater of claim 1, wherein a shape of the heating unit is selected from straight shape, U-type shape, zigzag shape, spiral shape, coil shape, and serpentine shape.

7. The electrical heater of claim 1, wherein said electrical resistance heating material features high-temperature stability and low thermal expansion.

8. The electrical heater of claim 1, wherein said electrical resistance heating material is in a form of a flat wire or a shaped wire having a cross-sectional shape selected from round shape, oval shape, polygonal shape, and D-shape.

9. The electrical heater of claim 1, wherein said electrical resistance heating material of the heating unit is doped with said at least one scale-forming element.

10. The electrical heater of claim 1, wherein said electrically insulating compound of the sheath is doped with said at least one scale-forming element.

11. A method of fabrication of an electrical heater for heating liquid containing at least one scale forming element, comprising:

(a) providing a heating unit including electrical resistance heating material;

(b) disposing a heat conducting sheath over at least a portion of said heating unit, where said heat conducting sheath includes electrically insulating compound that features anisotropic heat conductivity with enhanced transparency to infra-red radiation along axes normal to a surface of said electrical resistance heating material; and (c) providing a pair of terminal ends and applying them to said electrical resistance heating material for connecting said heating unit to an external source of electric power.

12. The method of claim 11, further comprising polishing at least a portion of an outer surface of the sheath that is in contact with the liquid.

13. The method of claim 11, wherein said providing of the heating unit includes:

(i) providing said electrical resistance heating material;

(ii) placing said electrical resistance heating material in a die; and (iii) applying at least one of pressure or heat to said electrical resistance heating material in the die.

14. The method of claim 11, wherein said disposing of the heat conducting sheath includes:

(i) placing at least a portion of the heating unit together with said electrically insulating compound in a die; and (ii) applying heat to the heating unit together with the electrically insulating compound.

15. The method of claim 11, comprising doping said electrical resistance heating material with said at least one scale-forming element.

16. The method of claim 11, comprising doping said electrically insulating compound of the sheath with said at least one scale-forming element.

17. A method of inhibiting scale formation on a surface of an electrical heater for heating liquid containing at least one scale forming element, the electrical heater having a heating unit including electrical resistance heating material, the method comprising disposing a heat conducting sheath over at least a portion of the heating unit, said heat conducting sheath includes electrically insulating compound that features anisotropic heat conductivity with enhanced transparency to infra-red radiation along axes normal to a surface of said heating unit.

18. The method of claim 17, further comprising polishing at least a portion of an outer surface of the sheath.

19. The method of claim 17, wherein said electrically insulating compound of the sheath features at least one characteristic selected from: liquid impermeability; hydrophobic characteristic; high-temperature stability, and has a crystal structure with a crystal lattice different from the crystal lattice of a scale deposit on an outer surface of the sheath.

20. The method of claim 17, comprising doping said electrical resistance heating material of the heating unit or/and said electrically insulating compound with said at least one scale-forming element.

* * * * *